United States Patent [19]

Harnden, Jr.

[11] 4,060,783

[45] Nov. 29, 1977

[54] MAGNETIC CIRCUIT AND METHOD OF MAKING

[75] Inventor: John D. Harnden, Jr., Schenectady, N.Y.

[73] Assignee: General Electric Co., Schenectady, N.Y.

[21] Appl. No.: 557,386

[22] Filed: Mar. 11, 1975

Related U.S. Application Data

[63] Continuation-in-part of Ser. No. 412,341, Nov. 2, 1973, abandoned.

[51] Int. Cl.[2] ..... H01F 1/08; H01F 21/02

[52] U.S. Cl. ..... 335/296; 336/15; 336/61

[58] Field of Search ..... 336/15, 61, 184, 192, 336/198, 208, 233; 335/296, 297, 299, 281

[56] References Cited

U.S. PATENT DOCUMENTS

| | | | |
|---|---|---|---|
| 3,001,161 | 9/1961 | Broadhead et al. | 336/15 |
| 3,019,375 | 1/1962 | Geyer et al. | 335/299 X |
| 3,112,898 | 12/1963 | Stahl | 336/198 X |
| 3,218,592 | 11/1965 | Barrick | 336/198 X |
| 3,614,692 | 10/1971 | Rozelle et al. | 336/15 |
| 3,617,966 | 11/1971 | Trench et al. | 336/61 |
| 3,678,429 | 7/1972 | Colin | 336/184 |

FOREIGN PATENT DOCUMENTS

| | | | |
|---|---|---|---|
| 1,424,518 | 12/1965 | France | 336/198 |
| 1,439,292 | 10/1968 | Germany | 336/233 |
| 766,946 | 1/1957 | United Kingdom | 336/184 |

*Primary Examiner*—Harold Broome
*Assistant Examiner*—Fred E. Bell
*Attorney, Agent, or Firm*—Jerome C. Squillaro; Joseph T. Cohen; Julius J. Zaskalicky

[57] ABSTRACT

A low cost magnetic circuit and method of making the same are disclosed. The magnetic circuit comprises an integral magnetic core having at least four legs in a closed magnetic path, at least one leg thereof with a circular cross section and a bobbin rotatably disposed about the circular portion for containing a coil winding. The coil is formed by rotating the bobbin while holding the core stationary.

13 Claims, 9 Drawing Figures

Fig. 1
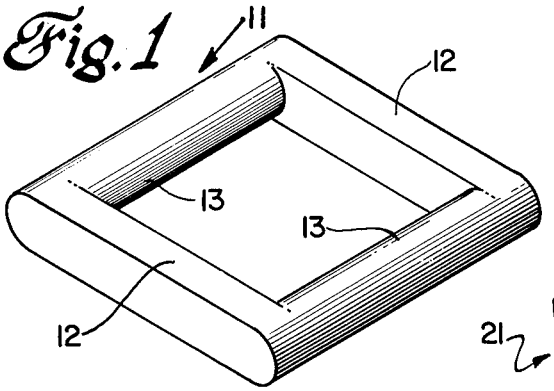
Fig. 2
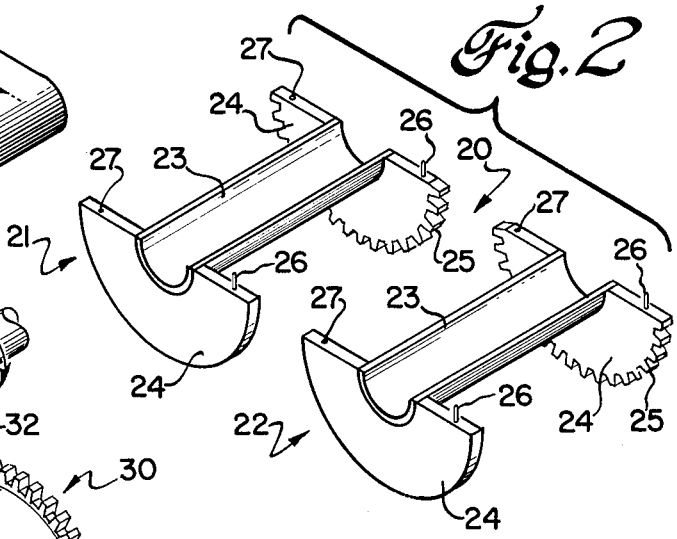
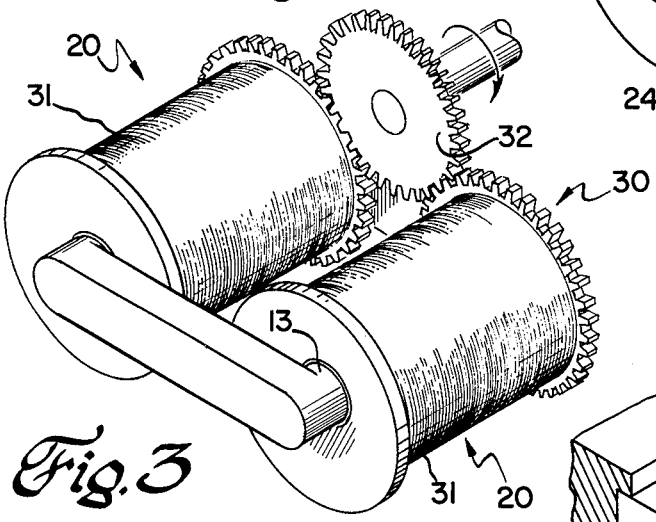
Fig. 3
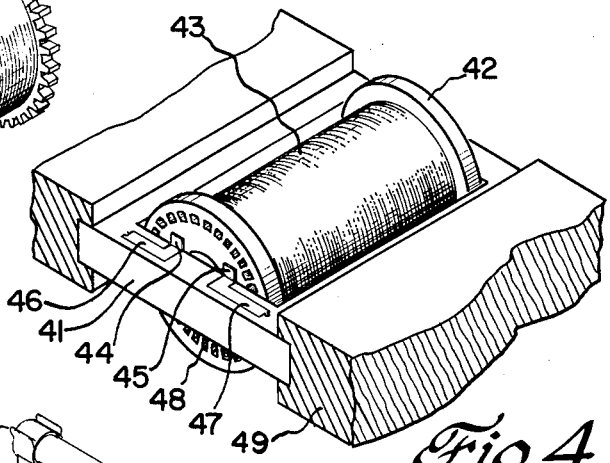
Fig. 4
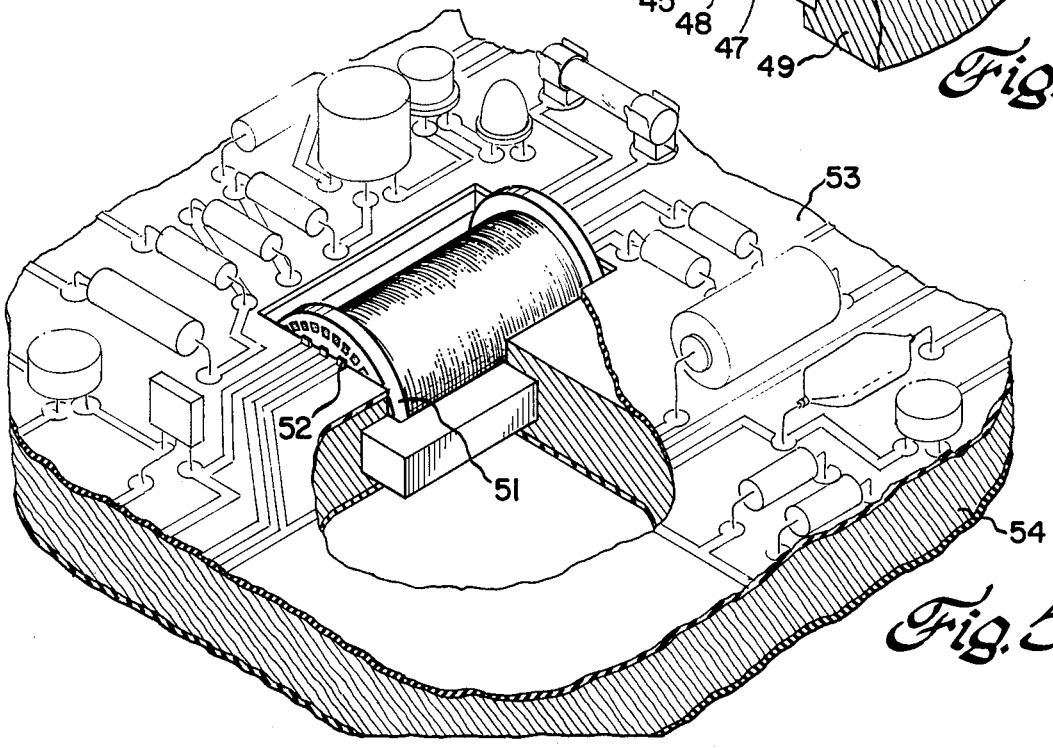
Fig. 5

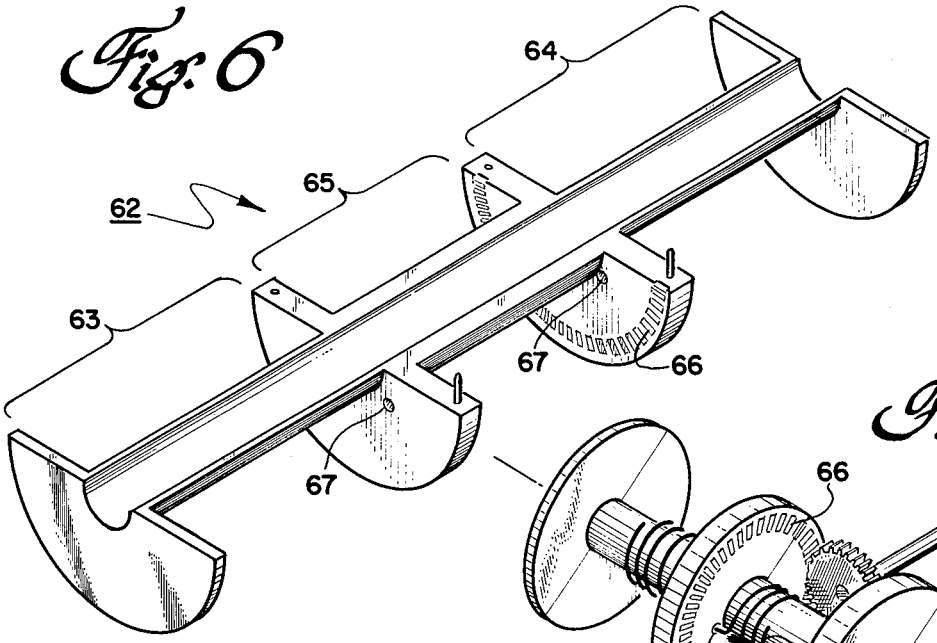
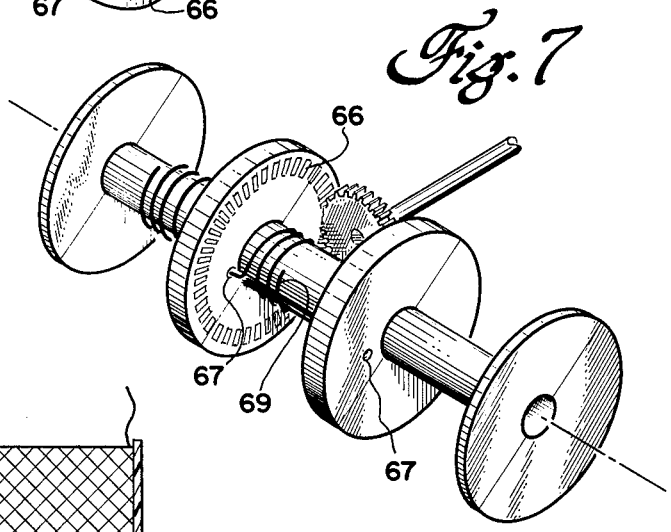
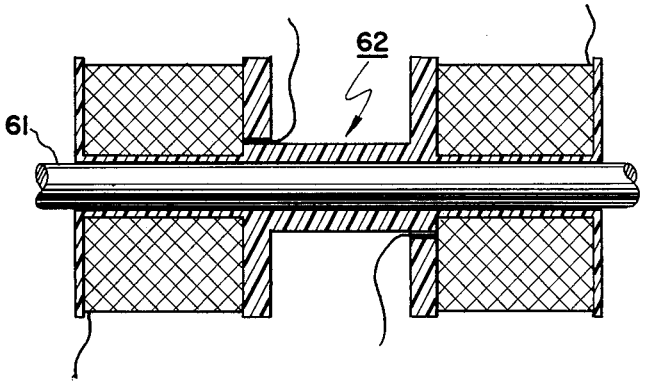
Fig. 8
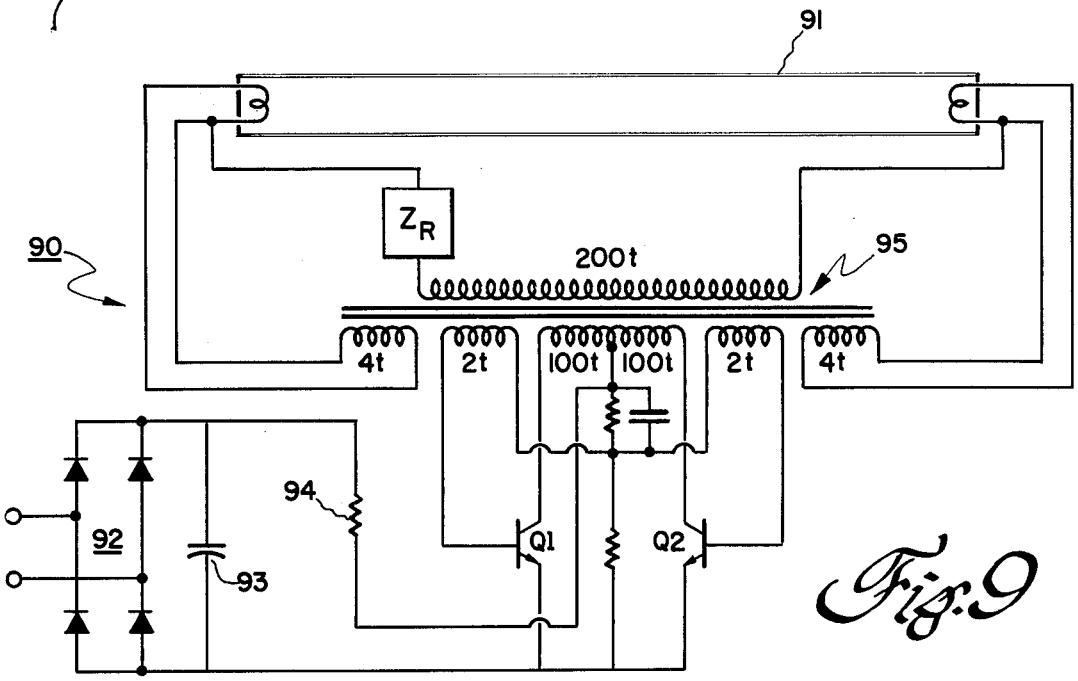
Fig. 9

MAGNETIC CIRCUIT AND METHOD OF MAKING

This application is a continuation-in-part of application Ser. No. 412,341, filed 11/2/73, now abandoned.

The present invention relates to magnetic circuits and more particularly to new and improved magnetic coils and methods of making the same.

Magnetic components such as transformers, reactors and simple inductors are in widespread use in power distribution and generation, electrical control circuitry, electric lighting and numerous other applications. In a number of these applications, the cost of fabricating the magnetic components is becoming an appreciable determining factor in the total cost of a piece of delivered equipment. For example, toroidal cores which are well known to provide high frequency capability with minimal leakage fields must be either hand or toroidally wound. Since toroidal winders as presently conceived are expensive to operate and may produce questionable integrity of wire insulation, new and improved means for providing toroidal core performance characteristics at lower cost are desirable. Further, where high voltage capability is required, the insulation required between winding layers and even between windings is often a difficult problem requiring hand-wound toroids. Still further, where precise winding characteristics are required with a high degree of reproducibility from unit to unit, such as in high production applications, present technology does not provide the high yields which produce low cost.

One technique proposed for winding magnetic coils with apparently minimum stray magnetic fields is described in German Pat. No. 1,439,292 issued Oct. 24, 1968 to Paul Mehler and entitled "Method of Manufacturing Electric Coils Without Stray Fields, Especially Miniature Coils for Printed Circuits." The magnetic coils described by this patent include a core having a central leg or bridge portion surrounded by a yoke structure with openings therein for inserting and assembling bobbin sections around the central leg. A coil is wound on the bobbin by rotating the bobbin relative to the core. As further described by this patent, magnetic coils wound on the described core exhibit minimal stray fields, a necessary requirement for miniature coil applications such as the ocean cable amplifiers referenced in the patent.

Whereas the above-referenced German patent relates to miniature coils with low power handling capability, it will become more apparent from the following description that my invention relates primarily to magnetic circuits for high power application, i.e., in excess of one watt power handling capability. In such applications, many of the advantages of the aforementioned miniature coils and method of making become disadvantageous for high power applications. For example, while minimal stray fields may be useful and necessary for low level signal applications, for high power applications described in accord with my invention, it is advantageous to have stray fields. In fact, the existence of stray fields is utilized to facilitate heat removal from the magnetic core and to increase leakage reactance, both very desirable characteristics for high power applications. Further, a simplified closed magnetic core structure of integral construction increases the winding area around the core, while simplifying the actual winding of the magnetic coil so that magnetic coils of substantially identical characteristics can be manufactured with a high degree of reproducibility and at very low costs.

Accordingly, it is an object of this invention to provide a low cost magnetic coil and method of making the same.

It is still another object of this invention to provide a high frequency magnetic structure which is characterized by its high voltage characteristics, controllable leakage reactance and improved heat transfer characteristics.

It is still another object of this invention to provide a magnetic structure characterized by its closed magnetic core of single piece integral construction with an improved bobbin structure disposed about a portion of the core having a circular cross section.

It is still a further object of this invention to provide an economical method of making magnetic structures and electromagnetic circuits having the aforementioned desirable characteristics.

Briefly, these and other objects of my invention are achieved in accord with one embodiment thereof wherein a closed magnetic core structure of integral one-piece construction and of generally rectangular shape with at least one portion of said core having a circular cross section is provided with at least one bobbin rotatably disposed about the circular portion for containing a coil winding. In one embodiment, the bobbin comprises cylindrical, complementary sections having a shape corresponding to that of the circular core section so that a minimum air gap exists therebetween. For selected applications, the bobbin material is selected to provide the desired dielectric strength to meet the voltage requirements of the magnetic structure. For certain applications, the bobbin is provided with two or more winding regions spatially separated from each other to provide a selected leakage reactance therebetween.

In accord with another aspect of my invention, external cooling of the core material is provided so that the temperature of the core remains below the Curie temperature of the magnetic material, thereby permitting higher power losses in the core without damaging the core material.

The novel features believed characteristic of my invention are set forth in the appended claims. The invention itself, together with further objects and advantages thereof, may better be understood with reference to the following detailed description taken in connection with the appended drawings in which:

FIG. 1 is a perspective view of a typical magnetic core useful in the practice of my invention;

FIG. 2 is a perspective view of an unassembled bobbin according to one embodiment of my invention;

FIG. 3 is an assembled magnetic structure illustrating two bobbins rotatably disposed on a magnetic core with means for rotating the bobbins;

FIG. 4 is a perspective view of an assembled magnetic structure with cooling means operatively connected thereto;

FIG. 5 is a perspective view of an assembled magnetic structure operatively connected with a printed circuit board including cooling means;

FIGS. 6 and 7 illustrate alternative embodiments of a bobbin used in the practice of the present invention;

FIG. 8 illustrates a transformer wound on a bobbin with the windings spatially separated from each other; and FIG. 9 illustrates a converter circuit including a novel transformer constructed in accord with the teachings of the present invention.

FIG. 1 illustrates a magnetic core structure 11 of generally square or rectangular shape in which opposite side members or legs 12 of any convenient cross section are substantially parallel to each other and in which orthogonally opposite sides 13 are of circular cross section. The magnetic core structure 11 may conveniently be formed by molding, casting, or other suitable techniques. By way of example, useful core materials include ferrites, flake and powdered irons, moly-permalloys, sendust comprising a composition of aluminum and iron powders, or other material useful in the fabrication of transformers, reactors, inductors and the like. Additionally, the aforementioned core materials may be mixed with nonmagnetic materials to control the magnetic properties of the core. Since one of the primary objects of my invention is to provide a low cost magnetic inductor, the core is of a single piece of integral scrapless construction and hence does not contemplate the use of laminated iron cores. Accordingly, as used herein, the term "integral construction" does not include laminated iron cores.

FIG. 2 illustrates a bobbin 20 comprising complementary sections 21 and 22 having a cylindrical center portion 23 with end flanges 24. The periphery of at least one of the end flanges 24 includes drive means 25, such as gear teeth, for example, for rotating the bobbin 20 in a manner described more fully below. The end flanges 24 further include interlocking means, illustrated for simplicity as a pin 26 and hole 27, for holding the complementary sections 21 and 22 together when the bobbin is placed on a magnetic core structure. Like the core structure 11, each complementary bobbin section is of one-piece molded construction. A useful material for this purpose is plastic, although other materials may also be used. By making each complementary section identical, only one mold is required so that manufacturing costs are reduced still further.

The complementary bobbin sections are assembled about the sides 13 and are held together with the interlocking means. The complementary bobbin sections 21 and 22 are dimensioned so that when placed about the sides of the core structure 11, a rotatably tight-fitting engagement which is completely or at least substantially completely devoid of air gaps is provided.

An assembled magnetic coil utilizing the magnetic core structure 11 and the bobbin 20 is illustrated in FIG. 3. In this Figure, two bobbins 20 are assembled on each side 13 of the core structure 11. The assembled magnetic coil 30 includes conductive windings 31 positioned on each bobbin 20 by rotating the bobbins 20 with a suitable driving means such as the gear 32.

Those skilled in the art can readily appreciate the numerous advantages flowing from magnetic coils constructed in accord with my invention. First and foremost, my invention provides magnetic coils for use in transformers, reactors, inductors and the like in a completely closed magnetic path, i.e., no air gap exists in the core structure. Presently, only the toroidal core affords this feature. Unfortunately, toroidal cores are too costly for most applications because of the high cost of winding such cores. The magnetic coil and method of making in accord with my invention, however, provide the full advantages of the toroidal core and at a substantially reduced winding cost.

Still another advantage of my invention which flows from the use of a "gapless" core structure is its self-shielding characteristics. That is, the flux lines produced in the core by the passage of current through the windings are contained wholly within the core structure, thereby keeping the flux density essentially uniform over the entire magnetic path. Stray magnetic fields hence have very little, if any, effect on magnetic coils constructed in accord with my invention. Further, magnetic losses generally associated with magnetic cores employing gaps are eliminated with the core structure of my invention. Still further, magnetostrictive and electromagnetic forces which produce chatter in laminated core structures and clamped multi-sectional cores are eliminated with my invention.

In addition to the foregoing advantages, the prior art problems of attempting to achieve transformers with balanced windings, such as those used in high frequency transformer applications, are substantially eliminated in accord with my invention. Since the bobbins are of identical size and shape and have a tight-fitting rotatable relationship with the core sides, it is an easy matter to produce identical windings on both bobbins so that substantially perfectly balanced windings are produced.

Further, because the bobbins are in tight-fitting relationship with the core and the windings on the bobbin are tightly wound, highly efficient electromagnetic coupling is provided between the core and the winding, thereby reducing leakage reactance of the magnetic circuit.

By selecting appropriate materials for the bobbins 20, it is possible to provide high voltage insulation between the windings and the core at a much lower cost and with a higher degree of reliability than provided with toroidal cores, for example.

FIG. 4 illustrates still another feature of my invention in which a magnetic core structure 41 of substantially rectangular shape with a central portion of circular cross section is provided with a bobbin 42 on which wire winding 43 is formed. In this embodiment of my invention, the peripheral regions of the core structure 41 are provided with cooling means 49 for removing heat from the core structure without reducing the size of the area available for the wire winding. The cooling means may include a high thermal conduction path to a heat sink or may be the heat sink itself. The use of such a cooling means overcomes one of the major limitations of high frequency transformers and reactors; that is, the core material is such a poor thermal conductor that temperature rises in the core material limit the power loss which can be tolerated in the core. The temperature limitation is imposed by the generally low Curie temperature of core materials, such as ferrites. For example, commonly used pot cores and the cores illustrated in the aforementioned German patent have a critical region centrally located within the core which cannot be cooled. Also, the windings cannot be cooled effectively because they are enclosed within the core. Accordingly, by providing external cooling means for the core material as well as the winding themselves, as described in accord with my invention, higher power can be dissipated without raising the temperature of the core material to a critical point.

FIG. 4 illustrates yet another feature of my invention wherein electrodes 44 and 45 formed in a flange of the bobbin 42 are directly connected to electrical contacts 46 and 47, respectively, which are formed on the surface of the core structure 41. In this embodiment of my invention, the core structure 41 must be electrically insulating so that contacts 46 and 47 are not shorted together. The use of ferrite materials are ideally suited for this purpose since they are electrically insulating. FIG. 4 also illustrates the use of alternative drive means 48 comprising gear teeth located along the flat surface of the bobbin flange. The use of this drive means permits maximum use of the bobbin space for the wire winding.

FIG. 5 also illustrates another feature of my invention wherein a bobbin 51 is provided with electrodes 52 formed in the bobbins themselves so that an assembled magnetic coil can be inserted as an integral part of a printed circuit board 53, for example, and provide the necessary interconnection between the windings and the circuit board. Alternatively, the connection to electrodes 52 may be made via a performed conductor system not predisposed on core 41, but after connection is made, may become attached thereto. FIG. 5 also illustrates cooling means 54 underlying the printed circuit board 53 and in thermal contact with the core of the magnetic coil. Printed circuit boards including cooling means such as that illustrated in FIG. 5 are well known in the art and are commercially available from sources such as Solitron Devices, Inc. of Tappan, New York under the name HI-PAC, or from American Enka Corporation, Brand-Rex Division of Willimantic, Connecticut.

Magnetic circuits constructed in accord with my invention are also particularly useful in connection with inverter and converter circuits where highly efficient magnetic coupling is required between certain windings of a transformer while providing loose coupling to at least another winding of the transformer. For example, where an inverter or converter circuit is utilized to power a fluorescent lamp, the voltage-current characteristic of the fluorescent lamp necessitates the inclusion of some type of ballasting impedance to limit current flow through the lamp. In accord with prior art techniques, such a ballasting impedance is generally provided by a suitable inductance serially connected with the voltage source providing power to the lamp. In accord with the present invention, as illustrated in FIGS. 6, 7 and 8, and as further depicted in the electrical schematic diagram of FIG. 9, the ballasting impedance is provided in the form of a selectable leakage reactance existing between the primary and secondary windings of a transformer.

Referring specifically to FIG. 6, one section of a two-section bobbin 62 is illustrated as comprising two regions 63 and 64 at opposite ends of the bobbin for containing conductive windings. The winding regions 63 and 64 are spatially separated from each other by a region 65 which includes drive means 66 along at least one bobbin flange for rotating the bobbin about a magnetic core, for example, as described above. The flange adjacent the region 65 also includes apertures 67 for threading one end of a coil winding therethrough.

FIG. 7 illustrates an assembled bobbin 62 with the complementary sections mated together with suitable interlocking means similar to those illustrated in FIG. 2, for example. A drive gear 68 in engagement with the drive means 66 illustrates the manner in which the bobbin is rotated for winding a coil thereon. As illustrated, a wire 69 passes through the aperture 67 and is secured to the bobbin temporarily to facilitate rotation of the bobbin and yet permit access to the end of the winding after the coil is wound. Alternatively, a radial grove in the side wall could be formed on the bobbin flange to make the wind-end available after the coil is wound.

FIG. 8 illustrates the bobbin 62 disposed about a leg 61 of a core, such as that illustrated in FIG. 1. The bobbin is in tight-fitting physical relationship with the core, but rotatable thereabout. In FIG. 8, the region 63 is utilized for primary and tertiary windings of a transformer, for example, while the region 64 is utilized for the secondary winding of the transformer. In such an arrangement, the leakage reactance existing between the primary and secondary winding is substantially fixed by the spacing therebetween. By appropriate selection of the desired spacing between the regions 63 and 64, it is possible to provide transformers with selectable leakage reactance, which reactance is precisely reproducible from a manufacturing standpoint, and hence highly desirable.

Yet another advantage of the spatial relationship provided by the embodiment illustrated in FIG. 8, is the low capacitive coupling between the primary and secondary windings of the transformer, a characteristic achieved only with great difficulty in conventional designs. Additionally, the spatial separation also insures high voltage insulation between the primary and secondary windings at no additional expense. Accordingly, those skilled in the art can readily appreciate that the selectable spatial separation between two electrical windings on a closed magnetic core provides numerous advantages over most prior art cores, including "U"s, "E"s, "I"s, "U-I"s, pot cores, toroidal cores and those cores described in the aforementioned German patent. Further, even if these functions could be provided with the aforementioned cores, the present invention provides these functions at a significantly lower cost because of the ease of winding my closed magnetic core structure.

Also, the existence of a selectable leakage reactance on the magnetic core constructed in accord with my invention provides yet another advantage: the ability to cool the core by natural or enhanced convection or conduction means without reducing the area available for winding. For example, in each of the magnetic circuits illustrated in the drawings, at least two sides of the core structure are easily accessible for providing cooling means to the core, thereby insuring operation below the Curie point temperature of the magnetic core material. Since the thermal conductivity of ferrite materials is, in general, very poor, it is particularly desirable to have direct access to portions of the core as near as possible to the hot spot for cooling purposes without sacrificing the area available for coil windings. For example, to provide comparable cooling means to a toroidal core would necessarily require access to the core itself and hence reduce the area available for coil windings.

FIG. 9 illustrates a typical converter, inverter circuit 90 for providing power to a load such as fluorescent lamp 91, for example, in which the novel closed magnetic core structure with the spatially related windings, illustrated in FIGS. 6, 7 and 8, provide improved circuit performance with less components and at lower cost than is achievable with either pot cores or toroidal cores. More specifically, FIG. 9 illustrates a bridge rectifier 92 connected to a suitable voltage source, such as 115 volts, 60 cycles A.C. The rectified A.C. voltage is applied to a filter capacitor 93 to provide the desired degree of filtering and through a current-limiting resistor 94 to the center tap of the primary winding of a transformer 95. As illustrated, the transformer 95 includes a secondary winding connected to a fluorescent lamp, for example, and tertiary windings for providing power to heat the filaments of the fluorescent lamp and for providing gating signals to the transistors $Q_1$ and $Q_2$ of the inverter.

Operationally, the 115 volts A.C. voltage is converted to a D.C. voltage of acceptable ripple and applied to the center tap of the primary winding. The transistors $Q_1$ and $Q_2$ conduct on alternate half-cycles by virtue of the drive signals applied to their base electrodes. The current flow through the primary winding induces a voltage in the secondary winding of sufficient magnitude to cause an arc discharge current to flow through the fluorescent lamp following ignition. Since the voltage-current characteristic of a conventionally ballasted fluorescent lamp includes a region of negative resistance, it is essential to provide an impedance in series with the arch discharge, to limit the current flow to a safe value. In accord with my invention, however, the impedance illustrated in FIG. 9 as $Z_R$ is, in fact, the leakage reactance existing between the primary and secondary windings of the transformer. As pointed out above, the leakage reactance is obtained as a result of the spatial relationship between the primary and secondary windings of the transformer.

In the winding of the transformer 95, the primary winding must be bifilarly wound on one portion of the bobbin 63, for example, to provide a tightly-coupled winding. Additionally, the heater windings and the transistor base drive windings are also tightly coupled to the primary winding by winding these tertiary windings directly over the primary winding. The secondary winding, on the other hand, is wound on the other portion 64 of the bobbin to provide a "loosely coupled" secondary winding. It should be pointed out, however, that because of the closed magnetic core structure in accord with my invention, all windings of the transformer are easily provided at very low costs (as compared to the aforementioned cores) and with a high degree of reproducibility required for high production manufacturing purposes.

By way of specific example, FIG. 9 illustrates the number of turns associated with each of the aforementioned windings on the transformer 95 utilized to operate a 15-watt conventional fluorescent lamp. The magnetic core on which the windings are formed is a manganese-zinc-ferrite having an electrical resistivity from 1 to approximately $10^4$ ohm-centimeters losses of 200 milliwatts/cm$^3$ and less at frequencies of approximately 25 kilohertz and flux densities of approximately 3–5 kilogauss.

Further, the general frequency range of interest for the present invention is within 3 to 100 kHz. Within this range, the normal laminated magnetic cores (no matter how thin the laminations) are inadequate for cost or efficiency reasons, and therefore are not used. Fundamentally, the basic transformer equation, i.e., $$E \alpha f BAN$$

WHERE :

E is the voltage on winding terminals
$f$ is frequency in hertz
B is flux density
A is area
N is number of turns which shows the aforementioned embodiments have approximately 100 less "AN" than conventional 60 hertz transformers. Further, "A" cannot change without limit, thus resulting in a few number of turns compared to 60 hertz designs.

Structurally, the circular cross-sectional core design and bobbins described above in accord with my invention provide an optimum configuration for enabling a high degree of reproducibility essential to mass production of such electromagnetic components necessitated by the fundamental design equation. This essential characteristic is not achievable, for example, with a square cross-sectional core configuration.

Where transformers constructed with the novel magnetic core of my invention are utilized in application where the size of a circular conductor becomes difficult to handle, the use of a metal foil conductor with suitable insulation between turns is preferable. Whereas the foil conductor is easily handled and terminated on the bobbins and cores described herein, the aforementioned prior art cores, including those described in the German patent, are not amenable to foil windings of this type.

In summary, therefore, I have described a novel closed magnetic core structure for magnetic circuits and method of making the same which is characterized by its low cost, controllable leakage reactance, high voltage insulating characteristics and improved heat transfer characteristics from the core.

Those skilled in the art can readily appreciate that numerous changes and modifications of my invention are possible. For example, the bobbin may be formed of more than two complementary sections, the drive means for rotating the bobbins may include gear teeth in the side walls of the bobbin flanges if desired, such as illustrated in FIGS. 4 and 5, or friction drive means may be utilized in place of the gear drive means if desired. Additionally, the bobbins may include separators on the central portion for providing separation between adjacent windings. Further, in addition to utilizing wire of circular cross-section for the windings, suitable conductive foils with appropriate insulation thereof may also be employed where desirable or necessary. Still further, various shaped core structures other than those illustrated could also be used in the practice of my invention. It is therefore intended that the appended claims over all such changes and modifications that fall within the true spirit and scope of this invention.

What I claim as new is:

1. An electromagnetic circuit comprising:

a closed magnetic core having at least four substantially orthoganally interconnecting side members forming a generally rectangular structure of integral nonlaminar construction wherein at least one side of said core structure is of circular cross section;

a bobbin rotatably disposed about said circular side and in tight fitting engagement therewith, said bobbin comprising cylindrical complementary sections, said sections including flanges having drive means for forming a winding on said bobbin and interlocking means for locking said sections about said circular side; and at least one conductive winding on said bobbin for providing highly efficient electromagnetic coupling between said core and said winding.

2. The electromagnetic circuit of claim 1 wherein said core structure includes a second side of circular cross section with a second bobbin disposed thereon and a conductive winding thereon.

3. The electromagnetic circuit of claim 1 wherein said drive means includes gear teeth disposed about the periphery of said flange.

4. The electromagnetic circuit of claim 1 wherein said core structure is selected from the group of materials consisting of ferrites, flake and powdered irons, molypermalloys, sendust and mixtures of said materials with nonmagnetic materials.

5. The electromagnetic circuit of claim 1 wherein said bobbin further includes at least one electrode on the flanges of said bobbin, said electrode electrically connected to one end of said winding.

6. The electromagnetic circuit of claim 1 further comprising:

another conductive winding on said bobbin, said conductive windings spatially separated from each other on said bobbin for providing a leakage reactance therebetween.

7. The electromagnetic circuit of claim 6 wherein the magnitude of the leakage reactance between said windings varies with the spacing therebetween.

8. The electromagnetic circuit of claim 1 wherein said conductive winding is a metal foil.

9. The electromagnetic circuit of claim 5 further comprising:

conductive means for making electrical contact with said electrode.

10. The electromagnetic circuit of claim 9 wherein said conductive means is in contacting relation with said core.

11. An electromagnetic circuit comprising:

a closed magnetic core having at least four substantially orthoganally interconnecting side members forming a generally rectangular structure of integral nonlaminar construction wherein at least one side of said core structure is of circular cross section;

a bobbin rotatably disposed about said circular side and in tight fitting engagement therewith;

at least one conductive winding on said bobbin for providing highly efficient electromagnetic coupling between said core and said winding; and cooling means including a high thermal conduction path in contacting relation with said core for removing heat thereform.

12. An electromagnetic circuit comprising:

a closed magnetic core having at least four substantially orthoganally interconnecting side members forming a generally rectangular structure of integral nonlaminar construction wherein at least one side of said core structure is of circular cross section;

a bobbin rotatably disposed about said circular side and in tight fitting engagement therewith; and at least one conductive winding on said bobbin for providing highly efficient electromagnetic coupling between said core and said winding, said bobbin including first and second regions spatially separated from each other and wherein said one conductive winding is wound in said first region.

13. The electromagnetic circuit of claim 12 further comprising another conductive winding on said bobbin, said other winding wound in said second region.

* * * * *